United States Patent [19]

Hanejko

[11] Patent Number: 4,499,049

[45] Date of Patent: Feb. 12, 1985

[54] METHOD OF CONSOLIDATING A METALLIC OR CERAMIC BODY

[75] Inventor: Francis G. Hanejko, Irvine, Calif.

[73] Assignee: Metal Alloys, Inc., Signal Hill, Calif.

[21] Appl. No.: 469,101

[22] Filed: Feb. 23, 1983

[51] Int. Cl.[3] ..... B22F 3/00

[52] U.S. Cl. ..... 419/49

[58] Field of Search ..... 419/6, 8, 28, 29, 48, 419/49, 56, 68, 66; 264/56, 500, 503

[56] References Cited

U.S. PATENT DOCUMENTS

| | | | |
|---|---|---|---|
| 3,279,917 | 10/1966 | Ballard et al. | 419/56 |
| 3,284,195 | 11/1966 | Googin et al. | 419/56 |
| 3,413,393 | 11/1968 | Turk | 419/48 |
| 3,455,682 | 7/1969 | Barbaras | 419/49 |
| 3,469,976 | 9/1969 | Iler | 419/49 |
| 3,689,259 | 9/1972 | Haily | 419/49 |
| 3,939,241 | 2/1976 | Powell et al. | 419/49 |
| 4,431,449 | 2/1984 | Dillon et al. | 419/48 |

*Primary Examiner*—Benjamin R. Padgett
*Assistant Examiner*—T. J. Wallen
*Attorney, Agent, or Firm*—Spensley Horn Jubas & Lubitz

[57] ABSTRACT

A method of consolidating a metallic or ceramic body is disclosed. The method comprises the steps of forming an article of manufacture from powdered metal; sintering the article of manufacture so as to increase the strength thereof; providing a bed of heated, generally spheroidal ceramic particles which have been coated with a thermally stable lubricant; and compacting the article of manufacture embedded in the heated bed under pressure to thereby consolidate the article into a dense, desired shape.

10 Claims, 5 Drawing Figures

METHOD OF CONSOLIDATING A METALLIC OR CERAMIC BODY

BACKGROUND OF THE INVENTION

1. Field of the Invention

This invention relates to the field of consolidating bodies, and more specifically, to an improved method which enables metallic or ceramic bodies to be made with minimal distortion.

2. Prior Art

Methodology associated with producing high density metallic objects by consolidation is recognized in the prior art. Exemplars of prior art references which discuss such methodology are U.S. Pat. Nos. 3,356,496 and 3,689,259. Prior to discussing these references, a brief discussion will be set forth which illustrates the two primary methodologies currently used to densify either loose powder or a prepressed metal powder compact. These two techniques are generally referred to as Hot Isostatic Pressing and Powder Forging. The Hot Isostatic Pressing ("HIP") process comprises placing loose metal powder or a prepressed compact into a metal can or mold and subsequently evacuating the atmosphere from the can, sealing the can to prevent any gases from reentering, and placing the can in a suitable pressure vessel. The vessel has internal heating elements to raise the temperature of the powder material to a suitable consolidation temperature. Internal temperatures of 1000° C. to 2100° C. are typically used depending upon the material being processed. Coincident with the increase in the internal temperature of the HIP vessel, the internal pressure is slowly increased and maintained at from 15,000 to about 30,000 psi again depending upon the material being processed. Under the combined effects of temperature and isostatic pressure, the powder is densified to the theoretical bulk density of the material.

A HIP vessel can accept more than one can during a given cycle and thus there is the ability to densify multiple powdered metal articles per cycle. In addition, by the use of isostatic pressure, the densification is more or less uniform throughout the HIPed article. By the use of suitable can design, it is possible to form undercuts for transverse holes or slots in the densified article. However, the cycle time of the charge is slow, often requiring 8 hours or longer for a single cycle. Further, at the completion of the cycle, the cans surrounding the powdered metal article have to be either machined off or chemically removed.

The second common method of densifying powdered metal is a technique referred to as Powder Forging ("PF"). The Powder Forging process comprises the steps of:

(a) cold compacting loose metal powder at room temperature in a closed die at pressures in the range of 10–50 TSI into a suitable geometry (often referred to as a "preform") for subsequent forging. At this stage, the preform is friable and may contain 20–30 percent porosity and its strength is derived from the mechanical interlocking of the powdered particles.

(b) sintering the preform (i.e. subjecting the preform to an elevated temperature at atmospheric pressure) under a protective atmosphere. Sintering causes solid state "welding" of the mechanically interlocked powdered particles.

(c) reheating the preform to a suitable forging temperature (depending upon the alloy). Alternately this reheating step may be incorporated into the sintering step.

(d) forging the preform in a closed die into the final shape. The die is typically maintained at a temperature of about 300° F. to 600° F.

The forging step eliminates the porosity inherent from the preforming and gives the final shape to the PF part.

Advantages of Powder Forging include: speed of operation (up to 1000 pieces per hour), ability to produce a net shape, mechanical properties substantially equivalent to conventionally forged products and increased material utilization. However, there are number of disadvantages including nonuniformity of density because of chilling of the preform when in contact with the relatively cold die, and the inability to form undercuts which can be done in HIP.

Now referring back to the patents mentioned above, such references disclose what appears to be a combination of isothermal and isostatic conditions of HIP and HIP's ability to form undercuts, with the high speed, low cost continuous production normally associated with Powder Forging. In the U.S. Pat. No. 3,356,496, the use of a cast ceramic outer container is taught as the primary heat barrier. In addition, this cast ceramic outer container when deformed causes nearly uniform distribution of pressure on the powdered material.

In the U.S. Pat. No. 3,689,259 the use of granular refractory materials is taught. This reference is intended as an improvement over the earlier U.S. Pat. No. 3,356,496 in relation to faster heating of the grain and faster heating of the prepressed part.

While the U.S. Pat. Nos. 3,356,496 and 3,689,259 may represent advances in the art, significant problems remain with respect to the use of a bed of ceramic into which a preform is placed prior to consolidation. More specifically, it has been found that the use of crushed and ground ceramics or carbides results in a significantly non-uniform pressure distribution from the top of the charge (the surface against the moving press member) to the bottom of the charge (the surface against the fixed press bed). This non-uniformity of pressure distribution is readily demonstrated when consolidating a prepressed right circular cylinder of a powdered material. After consolidation in a bed of crushed and ground or fused ceramic material to nearly 100% of bulk density, it was determined that the surface of the prepressed cylinder nearest the moving press ram was smaller in diameter than the surface nearest the fixed bed. Sectioning the consolidated cylinder along a diameter and examining the sectioned surface, indicated that it had the shape of a trapezoid. The above phenomena was observed in all consolidated articles when a crushed and ground or fused granular ceramic matrix was employed as the consolidation media.

The solution to the problems associated with such distortion and lack of dimentional stability in shape has proved ellusive, especially when the solution must also be applicable to mass production. The present invention provides a solution which is adaptable to mass production.

SUMMARY OF THE INVENTION

The present invention is directed to a method of consolidating metallic or ceramic bodies comprising the steps of:

(a) forming an article of manufacture from powdered metal or ceramic. Preferably, such forming step is done by compaction such as is well known in the art;

(b) sintering the article of manufacture so as to increase the strength thereof;

(c) In the next step a hot bed of generally spheroidal ceramic particles to which graphite or a similar lubricant has been added is provided into which the article of manufacture is embedded. This bed, preferably of alumuna ($Al_2O_3$) and lubricant, is made by initially heating the refractory particles and lubricating compound in a fluidized bed or by other equivalent means. In addition, because there are often times when the sintered article of manufacture is cooled, the article may be subsequently reheated and placed in the hot bed. Additional spheroidal ceramic particles and lubricating compound are then added to cover the article. Alternating layers of hot particles and hot articles of manufacture are also within the scope of this invention; and (d) compacting the article of manufacture in the hot bed under high pressure to thereby consolidate the article into a dense shape of the desired configuration.

By the use of the methodology of the present invention, substantially improved structural articles of manufacture can be made having minimal distortion.

The novel features which are believed to be characteristic of this invention, both as to its organization and method of operation, together with further objectives and advantages thereof will be better understood from the following description considered in connection with the accompanying drawings in which a presently preferred embodiment of the invention is illustrated by way of example. It is to be expressly understood, however, that the drawings are for the purposes of illustration and description only and are not intended as a definition of the limits of the invention.

A BRIEF DESCRIPTION OF THE DRAWINGS

BRIEF DETAILED DESCRIPTION OF THE INVENTION

Figure 1:
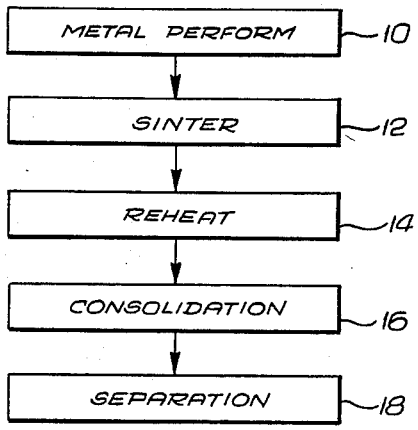
FIG. 1 is a flow diagram showing the method steps of the present invention.

Referring first to FIG. 1, there is shown a flow diagram illustrating the method steps of the present invention. As can be seen from numeral 10, initially a metal article of manufacture or preform is made, for example, in the shape of a wrench. While the preferred embodiment contemplates the use of a metal preform made of powdered steel particles, other metals and ceramic materials such as alumina, silica and the like are also within the scope of the invention. A preform typically is about 85 percent of theoretically density. After the powder has been made into a preformed shape, it is subsequently sintered in order to increase the strength. In the preferred embodiment, the sintering of the metal (steel) preform requires temperatures in the range of about 2,000° to 2,300° F. for a time of about 2–30 minutes in a protective atmosphere. In the preferred embodiment such protective, non-oxidizing inert atmosphere is nitrogen-based. Subsequent to sintering, illustrated at 12, the sintered preforms can be stored for later processing. Should such be the case, as illustrated at 14, the preform is subsequently reheated to approximately 1950° F. in a protective atmosphere.

The consolidation process, illustrated at 16, takes place after the hot preform has been placed in a bed of coated ceramic particles as hereinbelow discussed in greater detail. In order to generate the desired high quantity of production, alternating layers of hot coated ceramic particles and hot preforms can be used. Further, in order to speed up production, consolidation can take place subsequent to sintering so long as the preform is not permitted to cool. Consolidation takes place by subjecting the embedded preform to high temperature and pressure. For metal (steel) objects, temperatures in the range of about 2,000° F. and uniaxial pressures of about 40 TSI are used. Compaction at pressures of 10–60 tons depending on the material are also within the scope of the present invention. The preform has now been densified and can be separated, as noted at 18, where the coated ceramic particles separate readily from the preform and can be recycled. If necessary, any particles adhering to the preform can be removed and the final product can be further machined.

As discussed above, one problem associated with the use of a general ceramic bed was that the final product suffered from distortion. Microscopic examination of such crushed and ground or fused granular ceramic materials indicate a highly irregular shape, with many individual particles having a cross-sectional appearance either rectangular or triangular. However, by the use of the generally spherical ceramic particles of the present invention in combination with a lubricant, substantially less distortion is achieved.

More specifically, it was determined that by using a bed of spheroidal ceramic particles, preferrably alumina, without a lubricant, some minimal distortion remained. Even though the use of such bed produced articles of superior dimentional stability as compared with the prior art, the need to improve such dimentional stability remains. The present invention addresses this problem by incorporating a specific lubricant in an amount of about 1 to 2% by weight of the spheroidal ceramic particles into the bed of the spheroidal ceramic particles. In the preferred embodiment, carbon in the form of graphite having a particle size of less than 325 mesh is mixed with and adheres to the ceramic particles much like a coating. The addition of the graphite acts as a lubricant between the ceramic particles and enhances consolidation. Other similar thermally stable, generally non-reactive lubricants, such as molybdenum disulfide, mica, and the like are also within the scope of this invention.

In the preferred embodiment, the lubricant is mixed with alumina particles prior to forming the hot bed. Mixing can be accomplished in a V-blender or double cone, or other conventional systems so as to insure an intimate mixture of the lubricant and the ceramic particles.

The choice of the ceramic material for the bed is also important for another reason in the consolidation process. If a particle is chosen which shows a tendency for sintering at the consolidation temperature, the pressure applied will be absorbed in both densifying the prepressed powder metal and densifying the media. For example, using silica at a consolidation temperature of approximately 2000° F. will require higher pressure to achieve densification when compared with using alumina at the same temperature. The use of zirconium oxide, silica, or mullite at temperatures above 1700° F. results in higher densification pressures because these ceramics themselves begin to sinter at temperatures above 1700° F.

To overcome the sintering and resulting higher pressures required, with some ceramic materials spheriodal alumina is the preferred consolidation media up to temperatures of 2200° F. Further, spheroidal alumina possesses good flow characterics, heat transfer and a minimal amount of self-bonding during consolidation. An additional advantage of the spheroidal shape is the greatly reduced self bonding of the particles after consolidation. Preferrably, the spheroidal particles of the present invention have a size in the range of 100 to 140 mesh.

Figure 2:
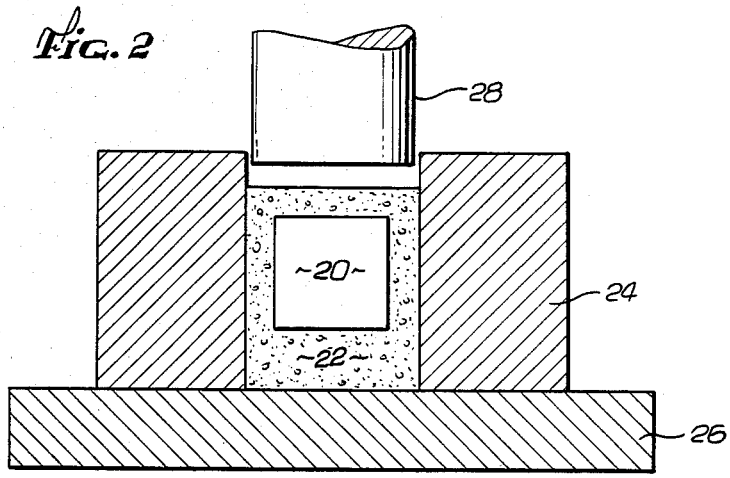
FIG. 2 is a cut-away plan view showing the consolidation step of the present invention.

Referring now to FIG. 2 the consolidation step is more completely illustrated. In the preferred embodiment, the preform 20 has been completely embedded in a bed of generally spheroidal alumina particles 22 which have been coated with a graphite lubricant, and which in turn have had placed in a consolidation die 24. Press bed 26 forms a bottom, while hydraulic press ram 28 defines a top and is used to press down onto the coated particles 22 and preform 20. The embedded metal powder preform 20 is rapidly compressed under high uniaxial pressure by the action of ram 28 in die 24. Die 28 has no defined shape (such as the shape of a wrench), and there is negligible lateral flow of the preform 20. As a consequence, consolidation occurs almost exclusively in the direction of ram 28 travel.

Figure 3:
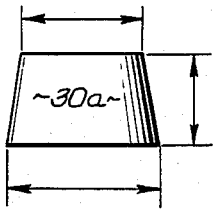
FIG. 3 is a plan view showing a consolidated article of manufacture which has been consolidated in a bed of alumina particles not of spheroidal shape.
Figure 4:
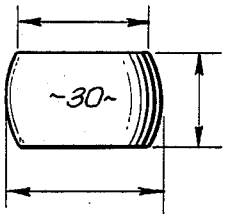
FIG. 4 is a plan view showing a consolidated article of manufacture which has been consolidated in a bed of spheroidal alumina particles.

As discussed above, use of nonspheroidal particles produces non-uniform pressure distribution such that after consolidation; a plan view of a cylinder 30*a* sectioned along a diameter would have the shape of a trapezoid as illustrated in FIG. 3 and would approach 100% of full density. Referring now to FIG. 4, one can see that the same prepressed right circular cylinder 30 when consolidated in a matrix of uncoated spheroidal alumina particle has equal diameters at the top and bottom with a slightly larger diameter at the mid-height. Why the large diameter occurred at the mid-height is not known; however, the difference in diameter was so significantly reduced as to constitute a distinct improvement over the prior art.

Figure 5:
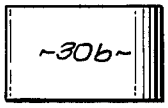
FIG. 5 is a plan view showing a consolidated article of manufacture which has been consolidated in a bed of spheroidal alumina particles coated with graphite.

However, to compensate for this distortion in the article associated with the use of the spheroidal alumina, further machining and/or redesigning of the preform is required. Referring now to FIG. 5, yet another right cyliner 30*b* is illustrated. In this embodiment, graphite has been coated onto the spheroidal alumina. As one can see, the cylinder 30*b* retained its original shape i.e. the diameter remained substantially uniform from top to bottom. Thus, by the use of a lubricant, the need for further machining and/or redesigning of the preform is substantially eliminated.

While the present invention is described it will be apparent to those skilled in the art that other embodiments are clearly within the scope of the present invention. For example, preform 20 can be a wrench or other similar object. Moreover, other generally spheroidal particles such as silica, $ZrO_2$ and similar ceramic oxides can be used for the bed. This invention, therefore, is not intended to be limited to the particular embodiments herein disclosed.

I claim:

1. A method of consolidating a metallic or ceramic body comprising the steps of:

(a) forming an article of manufacture from powdered metal or ceramic materials;

(b) sintering said article of manufacture so as to increase the strength thereof;

(c) providing a bed of heated, generally spheroidal ceramic particles which have been coated with a thermally stable, generally non-reactive lubricant; and (d) compacting said article of manufacture in said heated bed of generally spheroidal coated ceramic particles under high pressure to thereby consolidate said article of manufacture into a dense, desired shape.

2. A method of consolidating a metallic or ceramic body according to claim 1 wherein said article of manufacture is formed by compacting powdered metal.

3. A method of consolidating a metallic or ceramic body according to claim 1 wherein said generally spheroidal ceramic particles are alumina.

4. A method of consolidating a metallic or ceramic body according to claims 1 or 2 where said generally spheroidal ceramic particles have a size of less than 140 mesh.

5. A method of consolidating a metallic or ceramic body according to claims 1 or 3 wherein said lubricant is graphite.

6. A method of consolidating a metallic body comprising the steps of:

(a) forming an article of manufacture from powdered metal;

(b) sintering said article of manufacture so as to increase the strength thereof;

(c) providing a bed of heated, generally spheroidal ceramic particles which have been coated with a thermally stable, generally non-reactive lubricant;

(d) heating said coated article of manufacture to a predetermined temperature; and (e) compacting said object of manufacture in said heated bed of generally spheroidal coated ceramic particles under high pressure to thereby consolidate said article of manufacture into a dense, desired shape.

7. A method of consolidating a metallic body according to claim 6 where said generally spheroidal ceramic particles are alumina.

8. A method of consolidating a metallic body according to claim 6 where steps (b) and (d) are preformed in a protective atmosphere.

9. A method of consolidating a metallic body according to claim 7 where said generally spheroidal alumina particles have a size in the range of about 100 to 140 mesh.

10. A method of consolidating a metallic body according to claims 6 or 7 wherein said lubricant is graphite.

* * * * *